US005131153A

United States Patent [19]

Seales

[11] Patent Number: 5,131,153

[45] Date of Patent: Jul. 21, 1992

[54] BOW SIGHT

[76] Inventor: Milford L. Seales, 3626 Mayfair Rd., Montgomery, Ala. 36109

[21] Appl. No.: 754,600

[22] Filed: Sep. 4, 1991

[51] Int. Cl.[5] ..... F41G 1/467
[52] U.S. Cl. ..... 33/265; 124/87
[58] Field of Search ..... 33/265; 124/87

[56] References Cited

U.S. PATENT DOCUMENTS

| | | | |
|---|---|---|---|
| 3,234,651 | 2/1966 | Rivers | 33/265 |
| 3,389,695 | 6/1968 | Roloff et al. | 33/265 |
| 3,670,422 | 6/1972 | Stebbins et al. | 33/265 |
| 3,811,195 | 5/1974 | Carella | 33/265 |
| 4,136,462 | 1/1979 | Topel | 33/265 |
| 4,385,448 | 5/1983 | Burkey | 33/265 |
| 4,794,702 | 1/1989 | Martin | 33/265 |

*Primary Examiner*—William A. Cuchlinski, Jr.
*Assistant Examiner*—Alvin Wirthlin
*Attorney, Agent, or Firm*—Fleit, Jacobson, Cohn, Price, Holman & Stern

[57] ABSTRACT

A first horizontally opening U-shaped frame has the free ends of its legs independently adjustably supported, for longitudinal shifting, from an upstanding mounting member to define a bow sight window between the closed end of the frame and the mounting member. A thin, elongated upright sighting element has opposite ends supported from the legs of the frame for frictionally resisted shifting therealong and a second, larger, U-shaped frame is rigidly supported from the mounting member in position co-planer with and spaced from the first U-shaped frame for protection of the latter and the sighting element thereof against contact with adjacent objects. Further, the sighting element has a plurality of elevation indicating structures operatively associated therewith and spaced vertically therealong for indicating various selected points of elevation along the sighting element.

16 Claims, 1 Drawing Sheet

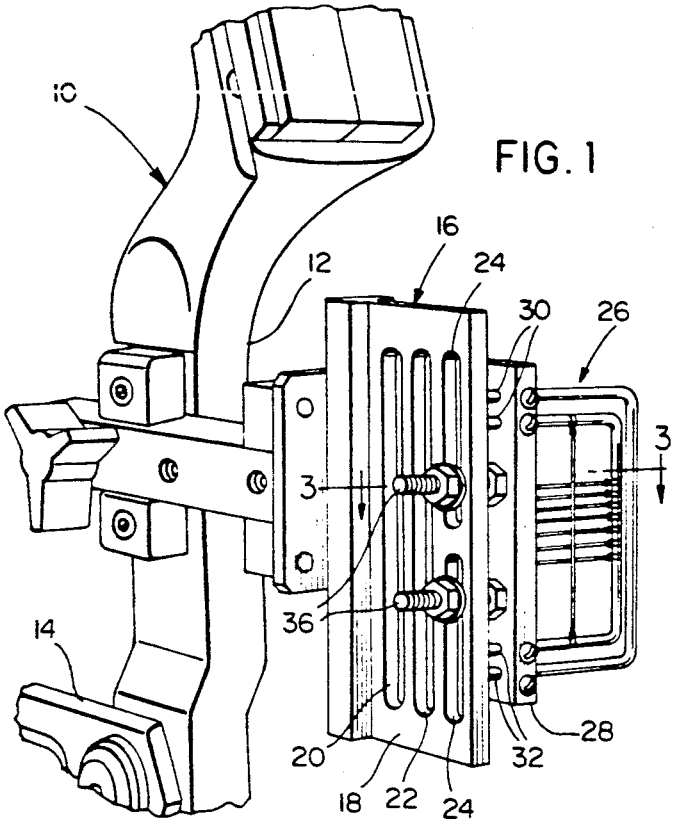
FIG. 1
FIG. 2
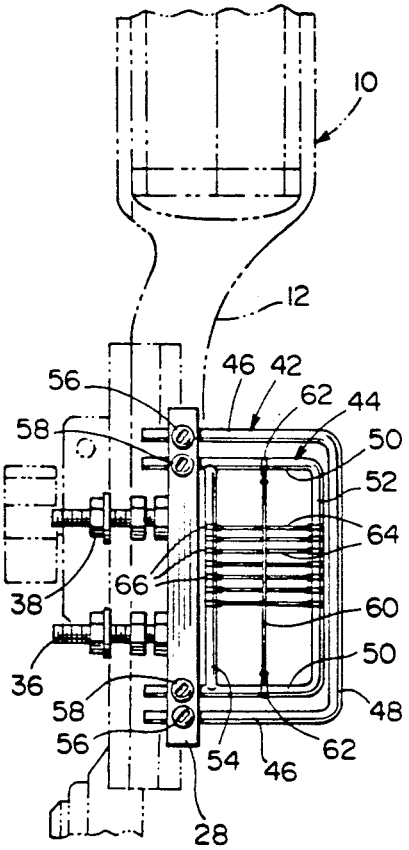
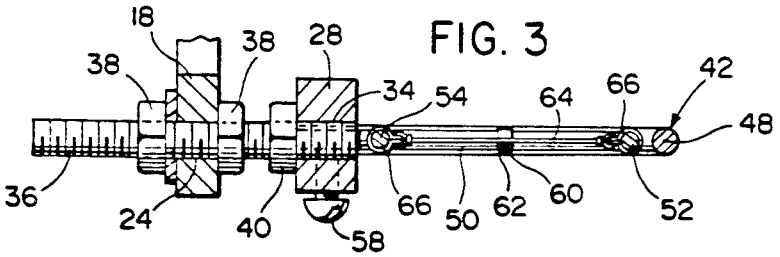
FIG. 3
FIG. 4
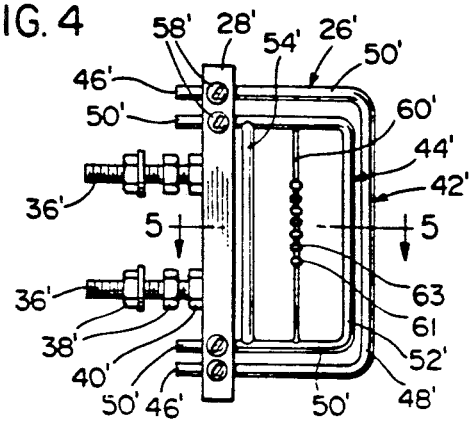
FIG. 5
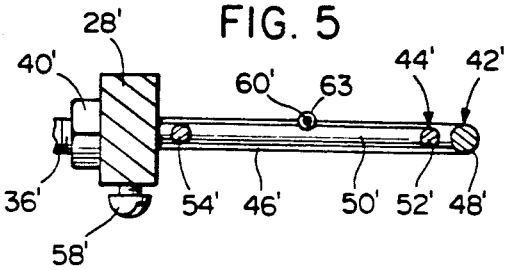

BOW SIGHT

BACKGROUND OF THE INVENTION

1. FIELD OF THE INVENTION

This invention relates to a bow sight to be used in conjunction with a bow having a laterally opening sight window and the sight is constructed in a manner whereby it may be adjusted for various distances on a particular bow and in conjunction with a given type of arrow, and further wherein the sight may be adjusted according to the shooting idiocrasy of a given bow hunter such that, with little practice, most bow hunters effectively may use the sight of the instant invention.

2. DESCRIPTION OF RELATED ART

Various different forms of bow sights for use in conjunction with bows equipped with sight windows heretofore have been provided. However, most previously known forms of bow sights require the use of tools for field adjustment thereof and, therefore, are not readily adaptable to substantially all shooting conditions which may be experienced by a bow hunter.

SUMMARY OF THE INVENTION

The sight of the instant invention incorporates a first small horizontally opening U-shaped frame and a second larger horizontally opening U-shaped frame with the two frames disposed in substantially the same vertical plane normal to the line of sight of an associated bow. The smaller frame includes an upstanding sighting element supported therefrom with the upper and lower ends of the sighting element anchored relative to upper and lower legs of the smaller frame. In addition, elevation indicating structure is operatively associated with the sighting element for indicating different positions therealong, the elevation indicating means each being independently vertically adjustable relative to the sighting element and the upper and lower legs of the smaller U-shaped frame being independently adjustably mounted from a generally vertical mounting member whereby the legs of the smaller frame may be independently slightly longitudinally shifted relative to the mounting member, the mounting member being vertically adjustable relative to a bow mounted bracket.

The larger outer frame serves the function of protecting the inner frame as well as the sighting element and elevation indicating means supported therefrom from accidental contact with stationary or moving objects, which contact might shift either the sighting element or one of the elevation indicating means relative to the small U-shaped frame.

The main object of this invention is to provide a bow sight which will enable the shooting characteristics of a particularly bow and arrow combination to be fully compensated for as to windage and elevation.

Yet another important object of this invention is to provide a sight which will be capable of at least substantially completely compensating for the shooting idiosyncrasy of a given bow hunter.

Yet another object of this invention is to provide a bow sight constructed in a manner which will enable the bow sight to be conveniently mounted upon many different forms of bow mounted sight brackets.

Ancillary object of this invention is to provide a bow sight which may be readily adapted to various different makes of bows.

A final object of this invention to be specifically enumerated herein is to provide a bow sight in accordance with the preceding objects and which will conform to conventional forms of manufacture, be of simple construction and easy to use so as to provide a device that will be economically feasible, long-lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a fragmentary perspective view of a typical form of compound bow upon which a removable and adjustable sight mounting bracket is mounted and from which mounting bracket the sight of the instant invention is supported;

FIG. 2 is a front elevational view of the bow sight of the instant invention with those portions of the bow and sight mounting bracket illustrated in FIG. 1 shown in phantom lines;

FIG. 3 is an enlarged fragmentary vertical sectional view taken substantially upon the plane indicated by the section line 3—3 of FIG. 1;

FIG. 4 is a front elevational view of a modified form of bow sight;

FIG. 5 is an enlarged horizontal sectional view taken substantially upon the plane indicated by the section line 5—5 of FIG. 4.

DESCRIPTION OF THE PREFERRED EMBODIMENTS

Referring now more specifically to the drawings the numeral 10 generally designates a conventional form of compound bow defining a laterally opening sight window 12 between the upper and lower arms thereof. The bow 10 may include an adjustable arrow rest structure 14 as well as a removable and adjustable sight mounting bracket assembly 16 including a vertically upstanding sight bracket 18 vertically slotted as at 20, 22 and 24.

The bow sight of the instant invention is referred to in general by the reference numeral 26 and includes an elongated upstanding mounting member 28 having upper and lower pairs of small smooth bores 30 and 32 formed therethrough as well as a pair of central more widely vertically spaced threaded bores 34 formed therethrough.

A pair of threaded mounting shanks 36 are secured through the slots 24 through the utilization of clamp nuts 38 and one end of each shank 36 is adjustably threadedly engaged in the corresponding threaded bore 34 and secured in adjusted position therein through the utilization of a jam nut 40.

A large U-shaped frame referred to in general by the reference numeral 42 is provided as well as a smaller U-shaped frame referred to in general by the reference numeral 44. The frame 42 includes a pair of parallel legs 46 interconnected at one pair of corresponding ends by an integral bight portion 48 and the smaller frame includes a pair of parallel legs 50 interconnected at one pair of corresponding ends by an integral bight portion 52. In addition, the smaller frame 44 includes a bar 54 secured and extending between the legs 50 spaced from the free ends thereof toward the bight portion 52.

The legs 46 are received through the upper bore 30 and the lowermost bore 32 and are secured in position therein through the utilization of set screws 56 while the free ends of the legs 50 are secured through the lowermost bore 30 and the uppermost bore 32 and secured in position therein through the utilization of set screws 58, the set screws 56 and 58 being threadedly engaged in suitable bores (not shown) provided therefore in the mounting member 28 and intersecting with the bores 30 and 32.

A single tension member sighting element 60 extends and is secured between the legs 50 centrally intermediate the bight portion 52 and the bar 54. The opposite ends of the tension member sighting element may be wrapped about and tied to the legs 50 for frictionally retained position thereon, or the opposite ends of the tension member sighting element may be anchored to partial circular clamps 62 frictionally clamped about the legs 50. The clamps 62 may, with sufficient finger or thumb pressure, be shifted longitudinally of the legs 50, as may be the opposite ends of the tension member sighting element 60 if they are wrapped and tied about the legs 50. In addition a plurality of elevation indicating tension members 64 extend and are secured between the bight portion 52 and the bar 54 at vertically spaced points therealong through the utilization of clamps 66 similar to the clamps 62, or the elevation indicating tension members 64 may have their ends wrapped around and tied to the bight portion 52 and the bar 54. In any event, the elevation indicating tension members 64 are frictionally retained in position, but may be shifted along the bight portion 52 and bar 64 upon the application of sufficient thumb or finger pressure thereon.

The frame 42 is spaced from the frame 44 and is disposed in the same plane as the frame 44. The frame 42 acts to protect the frame 44 against contact with moving or stationary objects and to prevent contact of any of the clamps 62 and 66 with stationary and or moving objects.

It will of course be appreciated that the intersection of each elevation indicating tension member with the tension member sighting element 60 defines "crosshairs" and a point of strike of an arrow at a predetermined distance from the bow 10.

With attention now invited more specifically to FIG. 4, there may be seen a modified form of bow sight 26', many portions of the bow sight 26' being identical to corresponding components of the bow sight 26 and, therefore, designated by prime reference numerals corresponding to the reference numerals utilized on the various corresponding components of the bow sight 26.

The bow sight 26', however, may have the bar 54' thereof corresponding to the bar 54 eliminated, inasmuch as the bar 54' serves no purpose other than to narrow the actual sight window defined by the bow sight 26'.

The bow sight 26' differs from the bow sight 26 in that it does not include elevation indicating tension members corresponding to the tension members 64 and the tension member sighting element 60' of the bow sight 26' actually comprises a stainless steel or other similar material wire whose opposite ends are lapped over the rear sides of the legs 50' of the small frame 44' and bonded thereto. The stainless steel wire 60' includes a plurality of two different types of elevation indicating members or beads 61 and 63 disposed thereon, frictionally retained in position on the wire 60' and forcefully, adjustably shiftable along the wire 60', as desired.

The sight 26' may be mounted relative to the sight bracket 18 in substantially the same manner as the bow sight 26 is mounted thereon and the legs of both pairs of U-shaped frames 42, 4, 42' and 44' may be shifted relative to and retained in adjusted shifted positions through the utilization of the corresponding set screws 56 and 58 and 56' and 58'.

The sight member 60 and tension members 64 may be constructed of "POLYMAR" (nylon) and the frames 42, 44, 42' and 44' also may be constructed of "POLYMAR" (nylon).

In order to sight in the bow sight 26, the bow 10 may be used to shoot an arrow at a backstop approximately ten yards away. If the arrow hits the backstop to the left of the target thereon, the tension member sighting element 60 is shifted slightly to the left. This is repeated until the arrow strikes the backstop along a vertical line coinciding with the tension member sighting element 60. Then, one of the elevation indicating tension members 64 may be positioned vertically along the tension member sighting element 60 to indicate the exact point of strike of the arrow on the backstop at ten yards. This may be repeated at five or ten yards increased distances from the target for successively adjusting each next upward elevation indicating tension member 64. Further, if the shooters idiosyncrasy involves some shooting habit which causes longer shots to fall either to the left or right of center, the upper end of the tension member sight element 60 may be shifted to the left or right, respectively, as needed. Then, it may be necessary to slightly shift the lower end of the tension member sighting element 60 to the right or left, respectively.

In the event a cross wind arises, the tension member sighting element 60 may be shifted to the left or right as desired, or the entire frame 44 may be shifted to the right or left. Also, adjustment of the sight 26' may be accomplished in substantially the same manner, except that if it is necessary to tilt the vertical tension member sighting element 60', it is necessary to adjust the small frame 44'.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. In combination, a bow having a laterally opening sight window, a sight bracket supported from said bow and spaced forward of said window, a bow sight, said bow sight including an elongated upstanding mounting member mounted from said bracket, and at least substantially entirely inward of the inner extremity of said window, for adjustable vertical shifting of said mounting member relative to said bracket, first and second large and smaller generally horizontally opening U-shaped frames disposed in substantially the same vertical plane and each including a pair of generally parallel legs interconnected at one pair of corresponding ends by a bight portion extending therebetween, said smaller frame being disposed within and spaced from said first frame, said legs of each frame being mounted from said mounting member, at points spaced therealong, the legs of at least said smaller frame being mounted for independent adjustable horizontal longitudinal shifting of said legs laterally of said mounting member, said smaller frame including a thin upstanding sighting element extending between and supported from the legs of said smaller frame intermediate the bight portion thereof and said mounting member.

2. The combination of claim 1 wherein said sighting element includes a plurality of elevation indicating means operatively associated therewith for indicating various selected points of elevation along said sighting element.

3. The combination of claim 2 wherein said elevation indicating means each include means for independent elevational adjustment relative to said sighting element.

4. The combination of claim 3 wherein said elevation indicating means comprise bead-like members mounted on said sighting element in frictionally retained position thereon.

5. The combination of claim 2 wherein said smaller frame includes a rigid bar extending between the legs thereof closely adjacent the side of said mounting member facing toward said bight portion of said smaller frame, said elevation indicating means each including a thin generally horizontal elevation indicating element mounted from and extending between said rigid bar and the bight portion of said smaller frame.

6. The combination of claim 5 wherein each of said elevation indicating elements mounted from said rigid bar and said bight portion of said smaller frame is slidably, adjustably supported therefrom and frictionally retained in adjusted shifted position therealong.

7. The combination of claim 6 wherein the sighting element supported from the legs of said smaller frame is slidably, adjustably supported therefrom and frictionally retained in adjusted shifted position therealong.

8. A sight for vertical adjustable mounting from an upstanding bow supported sight bracket, said sight including an elongated upstanding mounting member including mounting means adapting said mounting member for vertical adjustable mounting from said sight bracket, first and second large and smaller generally horizontally opening U-shaped frames disposed in substantially the sam vertical plane and each including a pair of generally parallel legs interconnected at one pair of corresponding ends by a bight portion extending therebetween, said smaller frame being disposed within and spaced from said first frame, said legs of each frame being mounted from said mounting member, at points spaced therealong, the legs of at least said smaller frame being mounted for independent adjustable horizontal longitudinal shifting of said legs laterally of said mounting member, said smaller frame including a thin upstanding sighting element extending between and supported from the legs of said smaller frame intermediate the bight portion thereof and said mounting member.

9. The sight of claim wherein said sighting element includes a plurality of elevation indicating means operatively associated therewith for indicating various selected points of elevation along said sighting element.

10. The sight of claim 9 wherein said elevation indicating means each include means for independent elevational adjustment relative to said sighting element.

11. The sight of claim 1 wherein said elevation indicating means comprise bead-like members mounted on said sighting element in frictionally retained position thereon.

12. The sight of claim 9 wherein said smaller frame includes a rigid bar extending between the legs thereof closely adjacent the side of said mounting member facing toward said bight portion of said smaller frame, said elevation indicating means each including a thin generally horizontal elevation indicating element mounted from and extending between said rigid bar and the bight portion of said smaller frame.

13. The sight of claim 12 wherein each of said elevation indicating elements mounted from said rigid bar and said bight portion of said smaller frame is slidably, adjustably supported therefrom and frictionally retained in adjusted shifted position therealong.

14. The sight of claim 12 wherein the sighting element supported from the legs of said smaller frame is slidably, adjustably supported therefrom and frictionally retained in adjusted shifted position therealong.

15. The sight of claim 12 wherein said elevation indicating elements each comprise an elongated tension member having opposite ends anchored relative to said bight portion and bar and slidably adjustably positionable therealong.

16. The sight of claim 8 wherein said sighting element includes an elongated tension member having opposite ends secured to and slidingly adjustably positionable along said legs of said smaller frame.

* * * * *